US008237072B2

(12) United States Patent
Kubota

(10) Patent No.: US 8,237,072 B2
(45) Date of Patent: Aug. 7, 2012

(54) PUSHBUTTON SWITCH

(75) Inventor: Yuji Kubota, Selma, AL (US)

(73) Assignee: Kabushiki Kaisha Honda Lock, Miyazaki (JP)

( * ) Notice: Subject to any disclaimer, the term of this patent is extended or adjusted under 35 U.S.C. 154(b) by 268 days.

(21) Appl. No.: 12/559,418

(22) Filed: Sep. 14, 2009

(65) Prior Publication Data

US 2010/0072050 A1 Mar. 25, 2010

(30) Foreign Application Priority Data

Sep. 25, 2008 (JP) ..... 2008-246782

(51) Int. Cl.
*H01H 13/06* (2006.01)
*H01H 3/16* (2006.01)
*H01H 13/00* (2006.01)

(52) U.S. Cl. ..... 200/302.2; 200/302.1; 200/296; 200/341; 200/345; 200/61.62

(58) Field of Classification Search ..... 200/61.62, 200/520, 293, 296, 302.1, 302.2, 329, 341, 200/344, 345
See application file for complete search history.

(56) References Cited

U.S. PATENT DOCUMENTS

| | | | | |
|---|---|---|---|---|
| 5,399,820 | A * | 3/1995 | Silfvast | 200/314 |
| 5,545,866 | A * | 8/1996 | Bulin et al. | 200/345 |
| 6,060,672 | A * | 5/2000 | Sugihara | 200/61.1 |
| 6,242,705 | B1 * | 6/2001 | Huang | 200/520 |
| 6,809,278 | B2 * | 10/2004 | Tsubaki | 200/341 |
| 7,365,281 | B2 * | 4/2008 | Yamaguchi et al. | 200/302.1 |
| 7,564,002 | B2 * | 7/2009 | Watanabe | 200/344 |
| 7,777,141 | B2 * | 8/2010 | Ishiguro | 200/61.52 |

FOREIGN PATENT DOCUMENTS

JP 3944975 B2 4/2007

* cited by examiner

*Primary Examiner* — Michael Friedhofer
(74) *Attorney, Agent, or Firm* — Arent Fox LLP

(57) ABSTRACT

A pushbutton switch includes a pushbutton for changing a switching mode of a tact switch provided on a switch holder fixedly disposed within a casing. The pushbutton includes a push operation portion disposed in a through hole provided in the casing and a collar that protrudes outwardly from the push operation portion and faces an inner face of the casing at the peripheral edge of the through hole. The pushbutton is connected to the switch holder and resiliently urged toward the side on which the collar gets closer to the inner face of the casing. Projections projecting toward the inner face of the casing are projectingly provided integrally at a plurality of positions spaced in the peripheral direction on an opposing face, of the collar of the pushbutton, that is opposed to the inner face of the casing. This prevents a freezing problem in the operation of a pushbutton.

4 Claims, 8 Drawing Sheets

PUSHBUTTON SWITCH

BACKGROUND OF THE INVENTION

1. Field of the Invention

The present invention relates to a pushbutton switch comprising a pushbutton for changing a switching mode of a tact switch provided on a switch holder fixedly disposed within a casing, the pushbutton including a push operation portion disposed in a through hole provided in the casing and a collar that protrudes outwardly from the push operation portion and faces an inner face of the casing at a peripheral edge of the through hole, the pushbutton being provided so as to be connected to the switch holder and being resiliently urged toward the side on which the collar gets closer to the inner face of the casing.

2. Description of the Related Art

Such a pushbutton switch is already known, as disclosed in Japanese Patent No. 3944975, and the like.

However, in the arrangement disclosed in Japanese Patent No. 3944975, in a non-operated state in which a pushbutton is not pushed into, the whole face of a collar of the pushbutton is in intimate contact with an inner face of a casing at the peripheral edge of a through hole. Because of this, in an environment in which an outer face of the casing is exposed to rainwater, etc. or in an environment in which humidity is high, moisture that has collected between the casing and the pushbutton freezes in response to a decrease in ambient temperature, and there is a possibility of a problem in the operation of the pushbutton being caused.

SUMMARY OF THE INVENTION

The present invention has been accomplished in the light of such circumstances, and it is an object thereof to provide a pushbutton switch that can prevent a problem in the operation of a pushbutton from being caused by freezing.

In order to achieve the object, according to a first feature of the present invention, there is provided a pushbutton switch comprising a pushbutton for changing a switching mode of a tact switch provided on a switch holder fixedly disposed within a casing, the pushbutton including a push operation portion disposed in a through hole provided in the casing and a collar that protrudes outwardly from the push operation portion and faces an inner face of the casing at a peripheral edge of the through hole, the pushbutton being provided so as to be connected to the switch holder and being resiliently urged toward the side on which the collar gets closer to the inner face of the casing, wherein projections projecting toward the inner face of the casing are projectingly provided integrally at a plurality of positions spaced in a peripheral direction on an opposing face, of the collar of the pushbutton, that is opposed to the inner face of the casing.

In accordance with the first feature of the present invention, when the pushbutton is not operated, the whole face of the opposing face of the collar that is opposed to the inner face of the casing does not abut against the inner face of the casing at the peripheral edge of the through hole, and even if the collar abuts thereagainst, since only the projections projectingly provided at a plurality of positions in the peripheral direction of the collar are in contact with the inner face of the casing, it is possible to prevent moisture such as rainwater from collecting between the pushbutton and the casing, and freezing does not cause a problem in the operation of the pushbutton.

According to a second feature of the present invention, in addition to the first feature, the switch holder is disposed at a fixed position within the casing so that there is a gap between a tip end of each of the projections and the inner face of the casing at the peripheral edge of the through hole in a state in which no operating force is applied to the pushbutton.

In accordance with the second feature of the present invention, since the switch holder is disposed at the fixed position within the casing so that the tip ends of the projections do not contact with the inner face of the casing, it is possible to more reliably prevent moisture such as rainwater from collecting between the pushbutton and the casing.

According to a third feature of the present invention, in addition to the second feature, each of the projections is formed so as to become tapered as it gets closer to the inner face of the casing.

In accordance with the third feature of the present invention, even if there is an error in assembling the switch holder at the fixed position within the casing and the projections come into contact with the inner face of the casing, since each projection is formed so as to become tapered as it gets closer to the inner face of the casing, the contact of the projection with the inner face of the casing can be made a point contact, thereby more reliably preventing moisture from collecting between the projection and the casing and freezing.

According to a fourth feature of the present invention, in addition to any one of the first to third features, guide projections, which are in point contact with guide portions provided on the casing side, are projectingly provided at a plurality of positions spaced in the peripheral direction of an outer periphery of the pushbutton.

Furthermore, in accordance with the fourth feature of the present invention, by making the plurality of guide projections on the outer periphery of the pushbutton be in point contact with the guide portions on the casing side, it is possible to guide the pushbutton so that it operates smoothly and prevent moisture from collecting between the guide projections and the guide portions, and by providing the guide projections it is possible to prevent any change in the operating load of the pushbutton from occurring.

The above and other objects, characteristics and advantages of the present invention will be clear from detailed descriptions which will be provided below for the preferred embodiment while referring to the attached drawings.

BRIEF DESCRIPTION OF THE DRAWINGS

FIG. 1 is a perspective view of a passenger vehicle seen from an obliquely-rearward side;

FIG. 2 is an enlarged view seen from an arrow 2 in FIG. 1;

FIG. 3 is an enlarged cross-sectional view taken along a line 3-3 in FIG. 2;

FIG. 4 is an enlarged cross-sectional view taken along a line 4-4 in FIG. 2;

FIG. 5 is an enlarged cross-sectional view taken along a line 5-5 in FIG. 2;

FIG. 6 is a perspective view showing an inner face side of a rear spoiler;

FIG. 7 is a perspective view corresponding to FIG. 6 in a state in which a bracket and a pushbutton switch are assembled to the rear spoiler; and FIG. 8 is an exploded perspective view of the bracket and the pushbutton switch.

DESCRIPTION OF THE PREFERRED EMBODIMENT

An embodiment of the present invention will be explained below with reference to the attached drawings.

Figure 1:
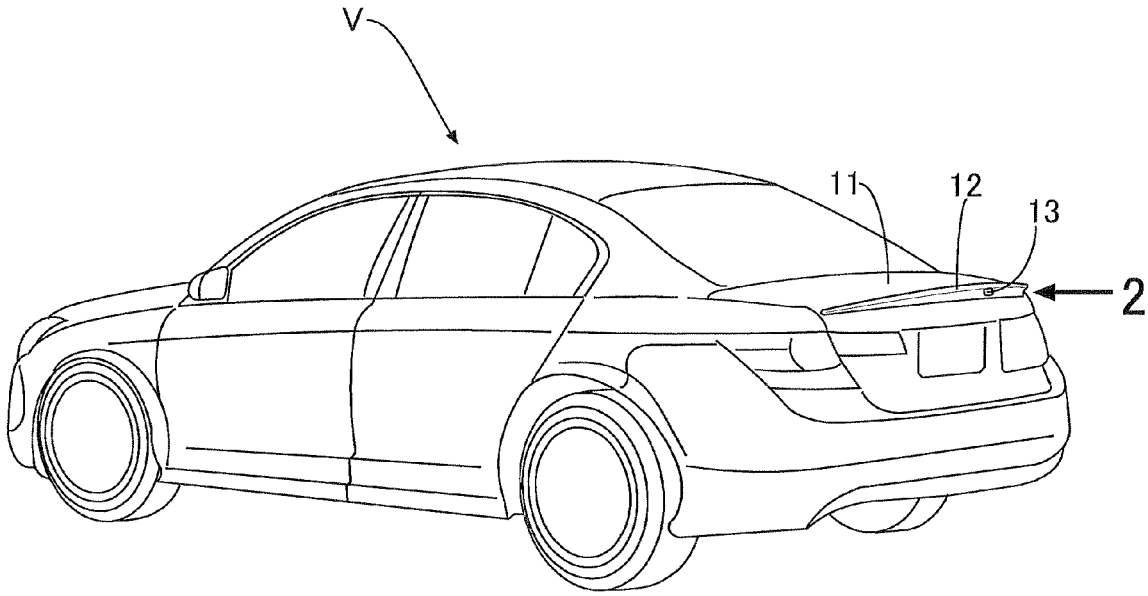
FIG. 1 to FIG. 8 show an embodiment of the present invention.
Figure 2:
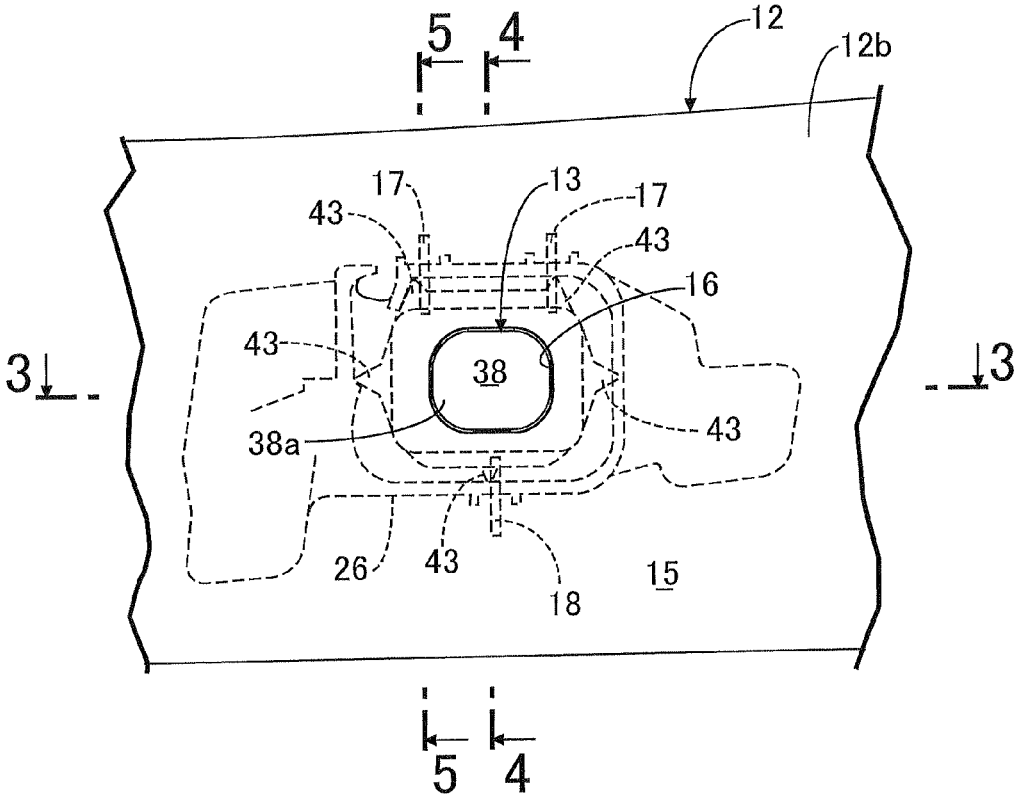
Figure 3:
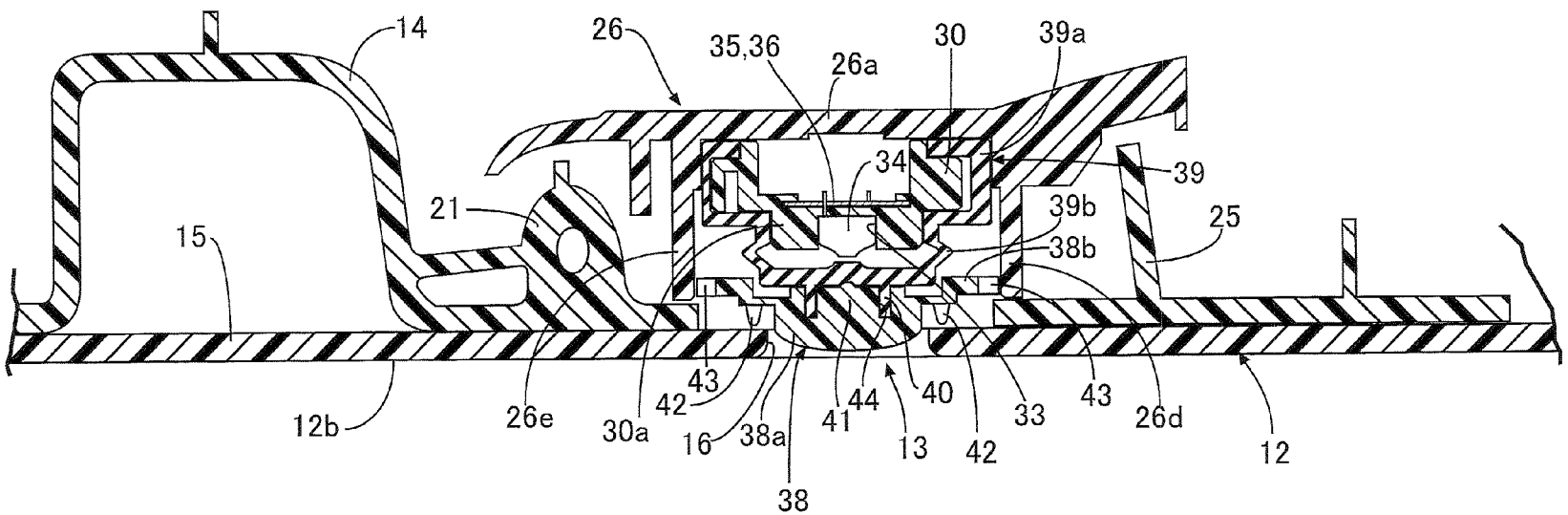
Figure 4:
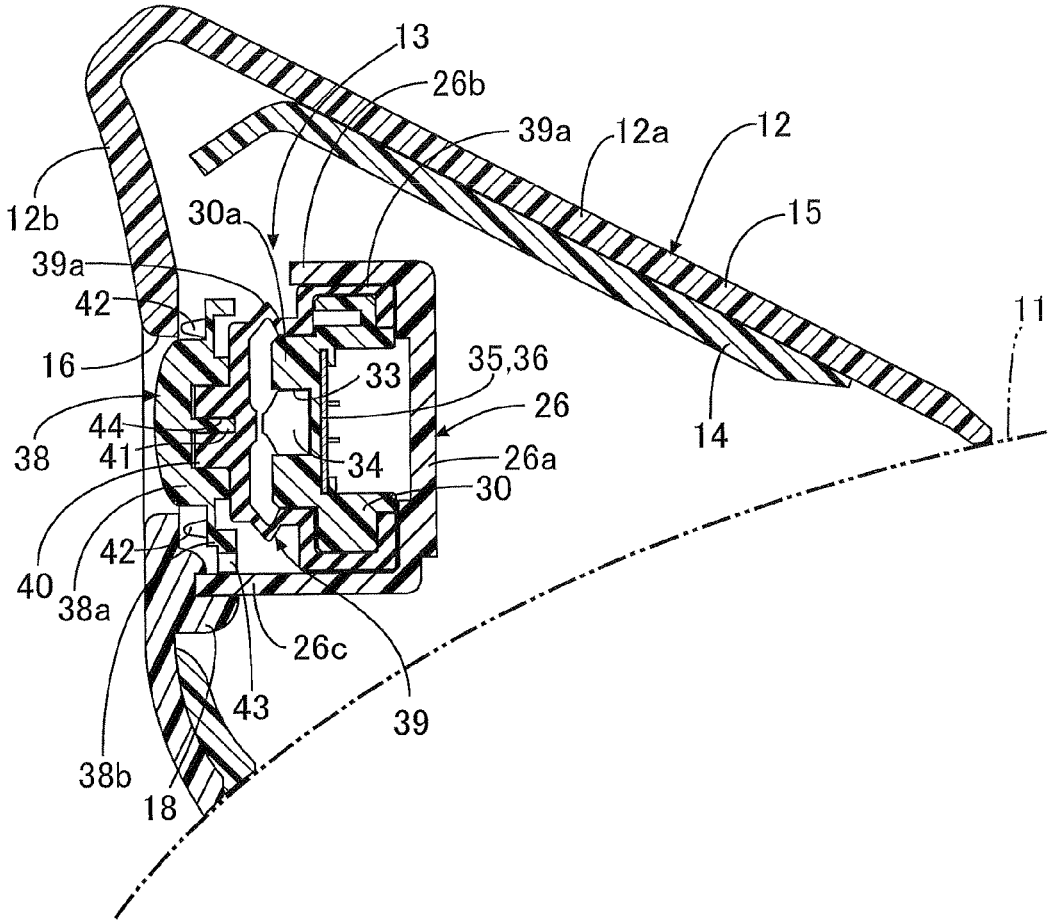
Figure 5:
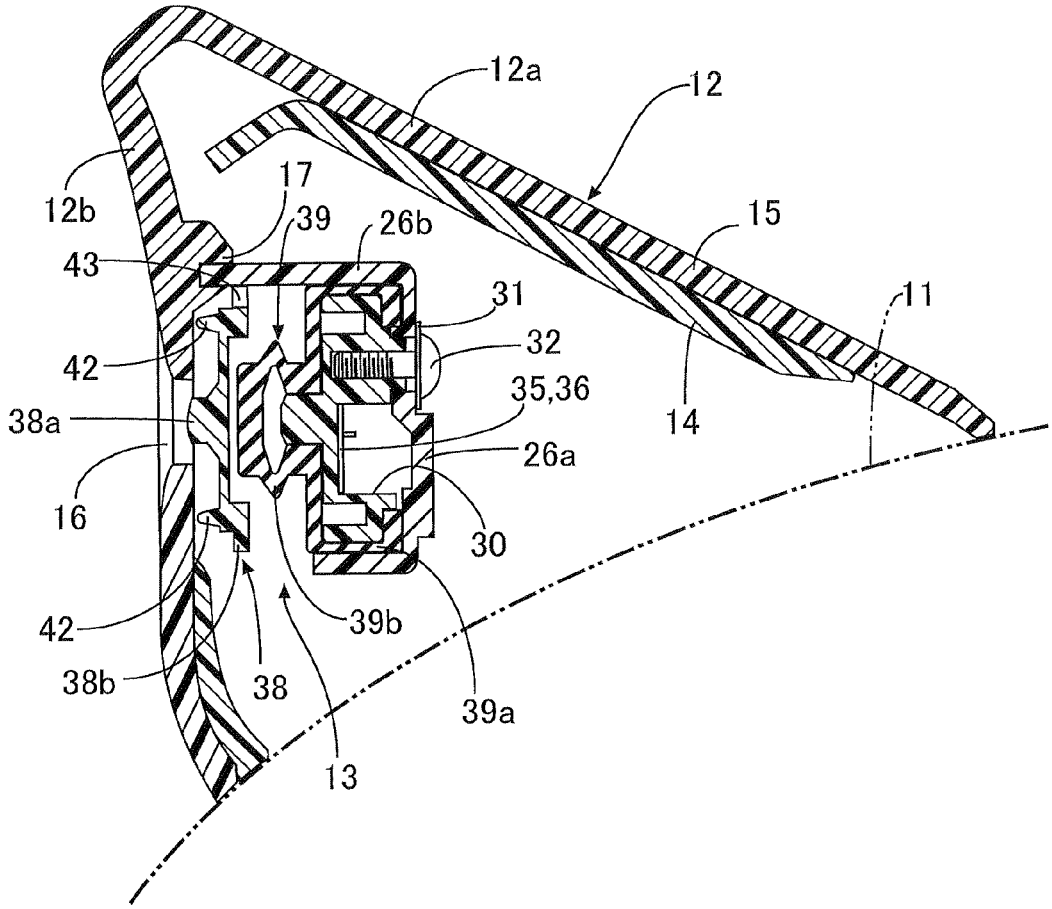

First, in FIG. 1 and FIG. 2, a rear spoiler 12, which is a casing, is mounted on an upper face of a rear part of a trunk lid 11 provided on a rear part of a passenger vehicle V, and a pushbutton switch 13 for sending out an unlock signal for releasing a locked state of the trunk lid 11 is disposed on the rear spoiler 12. That is, when the closed trunk lid 11 is in a locked state and the pushbutton switch 13 is pushed to put it in an ON state, bidirectional communication is carried out between a portable device carried by a vehicle driver and the vehicle side, and when it is confirmed by code verification that the portable device is legitimate, the locked state of the trunk lid 11 is released.

Referring in addition to FIG. 3 to FIG. 6, the rear spoiler 12 is formed so as to have a triangular cross-section in which an inner spoiler 14 formed from a high rigidity synthetic resin and an outer spoiler 15 formed from a painted synthetic resin are connected so that the outer spoiler 15 covers the inner spoiler 14, the rear spoiler 12 having an inclined portion 12*a* that is inclined upwardly to the rear and a vertical portion 12*b* that extends vertically downward from the upper end of the inclined portion 12*a*.

Figure 6:
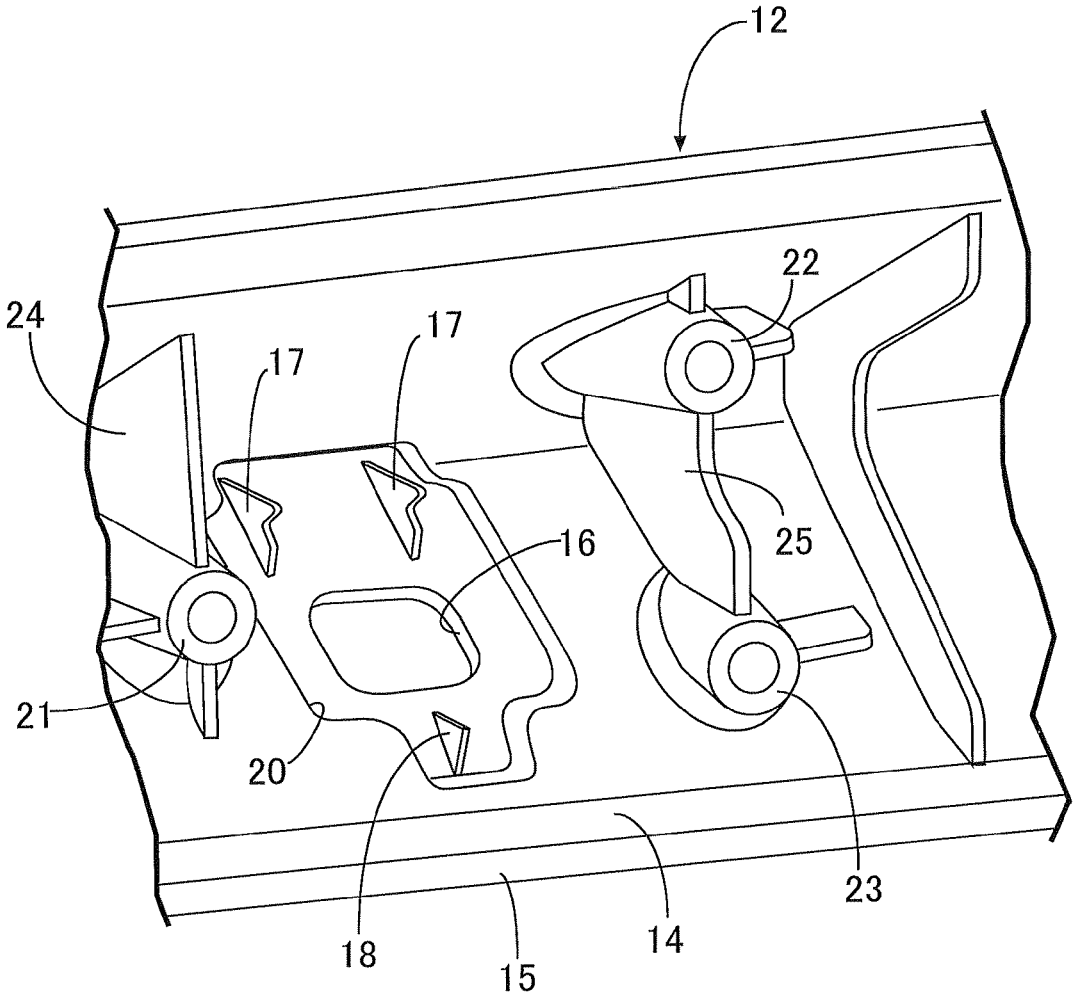

In the vertical portion 12*b* of the rear spoiler 12, a rectangular through hole 16 is provided in the outer spoiler 15, three positioning projections 17, 17, and 18 are projectingly provided on the inner face of the outer spoiler 15 as clearly shown in FIG. 6 so as to be disposed in the area around the through hole 16, the pair of positioning projections 17 and 17 being disposed above the through hole 16 and the remaining positioning projection 18 being disposed beneath the through hole 16. On the other hand, an opening 20 is provided in the inner spoiler 14 in the vertical portion 12*b* of the rear spoiler 12 so as to open larger than the through hole 16 in order that the through hole 16 and the positioning projections 17, 17, and 18 can be disposed, and a cylindrical first mounting boss 21 and cylindrical second and third mounting bosses 22 and 23 are projectingly provided on the inner face of the inner spoiler 14 in the area around the opening 20, the first mounting boss 21 being disposed on one side of the opening 20 and the second and third mounting bosses 22 and 23 being disposed on the other side of the opening 20. Moreover, a rib 24 and a rib 25 are provided integrally with the inner spoiler 14, the rib 24 extending radially outward from three positions in the peripheral direction of the first mounting boss 21, and the rib 25 joining the second and third mounting bosses 22 and 23.

Figure 7:
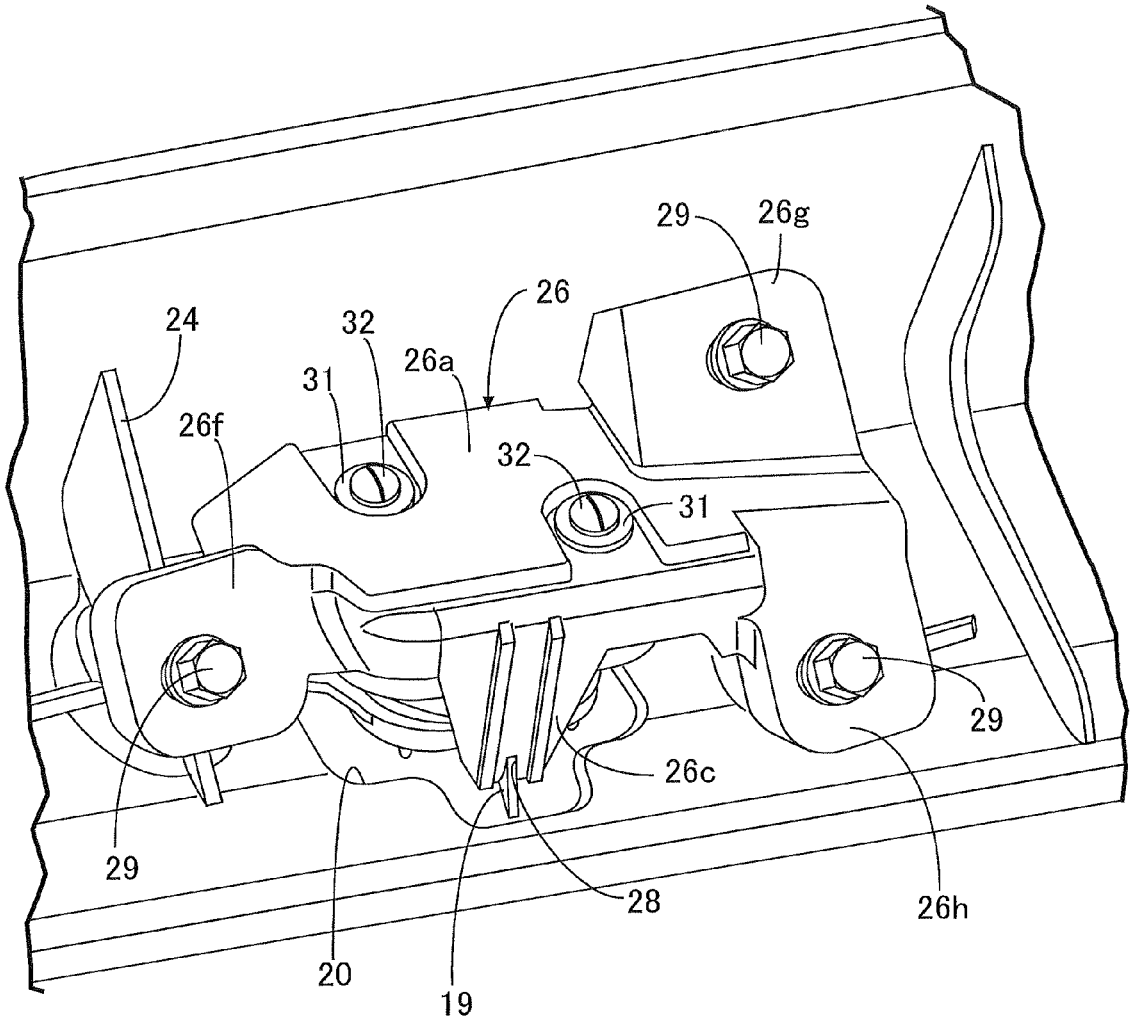
Figure 8:
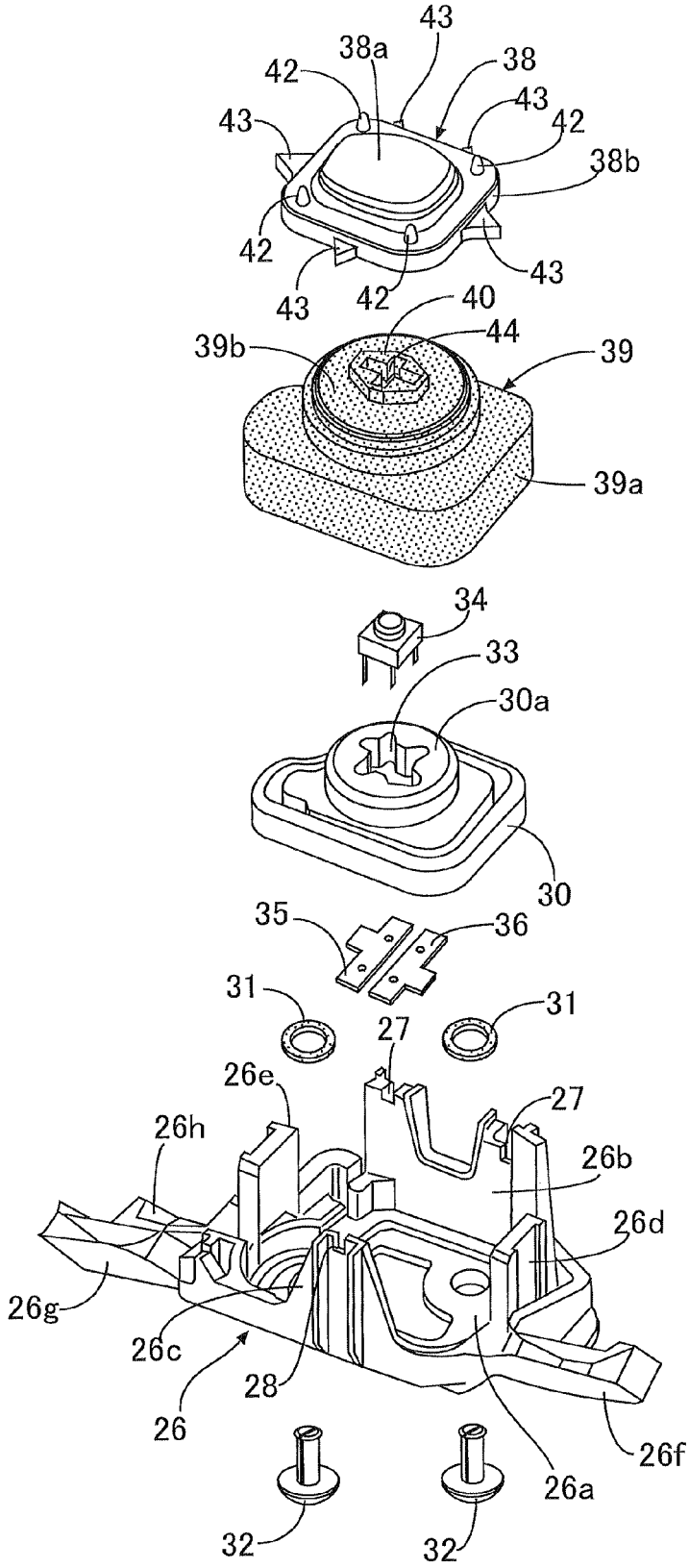

Referring in addition to FIG. 7 and FIG. 8, a bracket 26 formed from a synthetic resin is secured to the first to third mounting bosses 21 to 23 of the inner spoiler 14.

This bracket 26 is formed from a high rigidity synthetic resin while integrally having a holder support portion 26*a* that is formed in a box shape opening on the through hole 16 side so as to cover the through hole 16 from the inside of the rear spoiler 12, a first guide portion 26*b* that is disposed above the through hole 16 so as to extend from the holder support portion 26*a* toward the positioning projections 17 and 17 side of the outer spoiler 15, a second guide portion 26*c* that is disposed beneath the through hole 16 so as to extend from the holder support portion 26*a* toward the positioning projection 18 side of the outer spoiler 15, third and fourth guide portions 26*d* and 26*e* that extend from the holder support portion 26*a* toward the inner face of the outer spoiler 15 so as to be disposed at opposite sides of the through hole 16, a first arm portion 26*f* that extends from the holder support portion 26*a* toward the first mounting boss 21 side, a second arm portion 26*g* that extends from the holder support portion 26*a* toward the second mounting boss 22 side, and a third arm portion 26*h* that extends from the holder support portion 26*a* toward the third mounting boss 23 side.

A tip end portion of the first guide portion 26*b* is formed so as to be bifurcated in order to correspond to the pair of positioning projections 17 and 17 provided on the outer spoiler 15, and engagement recesses 27 and 27 that engage with the two positioning projections 17 and 17 respectively are provided at the tip of the first guide portion 26*b*. Furthermore, an engagement recess 28 that engages with the positioning projection 18 is provided at the tip of the second guide portion 26*c*. The bracket 26 is secured to the inner spoiler 14 of the rear spoiler 12 by fixing the first to third arm portions 26*f*, 26*g*, and 26*h* to the first to third mounting bosses 21, 22, and 23 by means of bolts 29 in a state in which the engagement recesses 27 are engaged with the positioning projections 17 and the engagement recess 28 is engaged with the positioning projection 18 so as to determine the position of the holder support portion 26*a* relative to the through hole 16.

A switch holder 30 is disposed within the holder support portion 26*a* of the bracket 26, and the switch holder 30 is fixed to the holder support portion 26*a* by screwing screw members 32 and 32 to the switch holder 30, the screw members 32 and 32 being inserted into the holder support portion 26*a* with washers 31 and 31 interposed between the holder support portion 26*a* and the screw members 32 and 32. That is, the switch holder 30 is fixedly disposed within the rear spoiler 12.

A projection 30*a* projecting toward the through hole 16 side is integrally provided on a center part of the switch holder 30, and a tact switch 34 is housed in a housing recess 33 which is provided in the projection 30*a* so as to be open at the tip end side of the projection 30*a*. A pair of terminal boards 35 and 36 are connected to the tact switch 34. The terminal boards 35 and 36, which are disposed in the side opposite to the projection 30*a* of the switch holder 30, are connected to the tact switch 34, thereby the tact switch 34 is fixed to the switch holder 30.

A switching mode of the tact switch 34 is changed by a push-operation of a pushbutton 38. The pushbutton 38 is connected to the switch holder 30 via a resilient member 39.

The resilient member 39 is formed from a resilient material such as rubber while integrally having a connecting tubular portion 39*a* formed so as to have tubular shape of a rectangular cross-section that engages with the switch holder 30 while having the outer periphery of the switch holder 30 fitted thereinto, and a resilient tubular portion 39*b* formed in a bottomed cylindrical shape and connected to the connecting tubular portion 39*a*, the pushbutton 38 being fixed to a closed tip end portion of the resilient tubular portion 39*b*. A fitting projection 40 is projectingly provided integrally with an outer face of the closed tip end portion of the resilient tubular portion 39*b*, and a cross-shaped groove 44 is provided in the fitting projection 40 so as to open on the tip side. On the other hand, a cross-shaped fitting part 41 that is fitted into the groove 44 is provided on the pushbutton 38, and the pushbutton 38 is fixed to the resilient tubular portion 39*b* of the resilient member 39 by means of an adhesive, etc. in a state in which the fitting part 41 is fitted into the groove 44.

The pushbutton 38 integrally has a push operation portion 38*a* disposed in the through hole 16 provided in the outer spoiler 15 of the rear spoiler 12 and a collar 38*b* extending outward from the push operation portion 38*a* and facing the inner face of the outer spoiler 15 at the peripheral edge of the through hole 16, and is resiliently urged toward the side on which the collar 38*b* gets closer to the inner face of the outer spoiler 15 by a resilient force exhibited by the resilient tubular portion 39*b* of the resilient member 39.

Projections 42 projecting toward the inner face of the outer spoiler 15 are projectingly provided integrally at a plurality of positions spaced in the peripheral direction on the opposing face, which is opposed to the inner face of the outer spoiler 15, of the collar 38*b* of the pushbutton 38. Further, each of the projections 42 is formed so as to become tapered as it gets closer to the inner face of the outer spoiler 15.

In addition, the switch holder 30 is disposed at a fixed position within the rear spoiler 12 via the bracket 26 so that there is a minute gap between the tip end of each of the projections 42 and the inner face of the outer spoiler 15 at the peripheral edge of the through hole 16 in a state in which no operating force is applied to the pushbutton 38.

Further, guide projections 43, which are placed in point contact with the guide portions 26*b*, 26*c*, 26*d*, and 26*e* provided on the rear spoiler 12 side, that is in this embodiment, the first to fourth guide portions 26*b*, 26*c*, 26*d*, and 26*e* of the bracket 26 fixed to the rear spoiler 12, are projectingly provided integrally on the outer periphery of the collar 38*b* of the pushbutton 38 at a plurality of positions spaced in its peripheral direction.

Next, the operation of this embodiment is explained. The pushbutton 38 for changing the switching mode of the tact switch 34 integrally has the push operation portion 38*a* disposed in the through hole 16 provided in the outer spoiler 15 of the rear spoiler 12 and the collar 38*b* extending outward from the push operation portion 38*a* and facing the inner face of the outer spoiler 15 at the peripheral edge of the through hole 16, and is resiliently urged toward the side on which the collar 38*b* gets closer to the inner face of the outer spoiler 15 by a resilient force exhibited by the resilient tubular portion 39*b* of the resilient member 39. Since the projections 42 projecting toward the inner face of the outer spoiler 15 are projectingly provided integrally at a plurality of positions spaced in the peripheral direction on the opposing face, of the collar 38*b*, that is opposed to the inner face of the outer spoiler 15, when the pushbutton 38 is not operated, the whole face of the opposing face of the collar 38*b* that is opposed to the inner face of the outer spoiler 15 does not abut against the inner face of the outer spoiler 15 at the peripheral edge of the through hole 16; even if the collar 38*b* abuts thereagainst, only the projections 42 projectingly provided at the plurality of positions in the peripheral direction of the collar 38*b* are in contact with the inner face of the outer spoiler 15. Accordingly, it is possible to prevent moisture such as rainwater from collecting between the pushbutton 38 and the outer spoiler 15 of the rear spoiler 12, thus preventing a problem in the operation of the pushbutton 38 being caused by freezing.

Furthermore, since the switch holder 30 is disposed at a fixed position within the rear spoiler 12 so that there is a gap between the tip end of each of the projections 42 and the inner face of the outer spoiler 15 at the peripheral edge of the through hole 16 in a state in which no operating force is applied to the pushbutton 38, it is possible to reliably prevent moisture such as rainwater from collecting between the pushbutton 38 and the rear spoiler 12. Moreover, in accordance with this embodiment, the resilient member 39 between the pushbutton 38 and the switch holder 30 integrally has the connecting tubular portion 39*a*, which is engaged with the switch holder 30 while having the outer periphery of the switch holder 30 fitted thereinto, and the resilient tubular portion 39*b*, which is formed in a bottomed cylindrical shape and connected to the connecting tubular portion 39*a*; when the volume of a space between the resilient tubular portion 39*b* and the switch holder 30 increases in response to an increase in temperature, if the state were such that the collar 38*b* of the pushbutton 38 abutted against the inner face of the outer spoiler 15 in an area around the through hole 16, the resilient tubular portion 39*b* would be prevented from elongating in the axial direction, and there would be a possibility that air that had expanded within the space would escape outward from between the switch holder 30 and the connecting tubular portion 39*a*, thus degrading the sealing properties of the tact switch 34, but since there is a gap between the tip end of each of the projections 42 and the inner face of the outer spoiler 15 at the peripheral edge of the through hole 16 in a state in which no operating force is applied to the pushbutton 38, it is possible to prevent the occurrence of such a possibility.

Furthermore, since each of the projections 42 is formed so as to become tapered as it gets closer to the inner face of the outer spoiler 15, even if an error in assembling the switch holder 30 at a fixed position of the outer spoiler 14 occurs and the projection 42 comes into contact with the outer spoiler 15, the contact of the projection 42 with the inner face of the outer spoiler 15 can be made a point contact, thus preventing moisture from collecting between the projection 42 and the outer spoiler 15 and thereby more reliably preventing freezing.

Moreover, since the guide projections 43, which make point contact with the first to fourth guide portions 26*b*, 26*c*, 26*d*, and 26*e* of the bracket 26 fixed to the rear spoiler 12, are projectingly provided at a plurality of positions spaced in the peripheral direction of the outer periphery of the collar 38*b* of the pushbutton 38, it is possible to guide the pushbutton 38 so as to operate smoothly and prevent moisture from collecting between the guide projections 43 and the first to fourth guide portions 26*b*, 26*c*, 26*d*, and 26*e*, and by providing the guide projections 43 it is possible to avoid any change in the operating load of the pushbutton 38.

An embodiment of the present invention is explained above, but the present invention is not limited to the above-mentioned embodiment and may be modified in a variety of ways as long as the modifications do not depart from the gist of the present invention.

For example, the present invention can be applied to a pushbutton switch used for a door lock switch of a vehicular outer handle system, and also can be widely applied to other pushbutton switches. Especially, the present invention can be preferably put into practice as a pushbutton switch of an apparatus used outside.

What is claimed is:

1. A pushbutton switch comprising a pushbutton for changing a switching mode of a tact switch provided on a switch holder fixedly disposed within a casing, the pushbutton switch including a push operation portion disposed in a through hole provided in the casing and a collar that protrudes outwardly from the push operation portion and faces an inner face of the casing at a peripheral edge of the through hole, the pushbutton switch being provided so as to be connected to the switch holder and being resiliently urged toward the side on which the collar gets closer to the inner face of the casing, wherein projections projecting toward the inner face of the casing are projectingly provided integrally at a plurality of positions spaced in a peripheral direction on an face of the collar of the pushbutton switch that is opposed to the inner face of the casing; and wherein the push operation portion and the switch holder are connected via a resilient tubular portion.

2. The pushbutton switch according to claim 1, wherein the switch holder is disposed at a fixed position within the casing so that there is a gap between a tip end of each of the projections and the inner face of the casing at the peripheral edge of the through hole in a state in which no operating force is applied to the pushbutton.

3. The pushbutton switch according to claim 2, wherein each of the projections is formed so as to become tapered as it gets closer to the inner face of the casing.

4. The pushbutton switch according to any one of claims 1 to 3, wherein guide projections, which are in point contact with guide portions provided on the casing side, are projectingly provided at a plurality of positions spaced in the peripheral direction of an outer periphery of the pushbutton.

* * * * *